United States Patent [19]

Bryant, II

[11] 4,299,563

[45] Nov. 10, 1981

[54] CYCLONE PROCESSOR AND SEPARATOR

[75] Inventor: Robert S. Bryant, II, Buffalo, N.Y.

[73] Assignee: National Gypsum Company, Dallas, Tex.

[21] Appl. No.: 155,056

[22] Filed: Jun. 2, 1980

[51] Int. Cl.[3] ..... F27B 15/00; F26B 17/00

[52] U.S. Cl. ..... 432/58; 34/57 E

[58] Field of Search ..... 432/58; 34/57 E

[56] References Cited

U.S. PATENT DOCUMENTS

| | | | |
|---|---|---|---|
| 1,509,915 | 9/1924 | Stebbins | 34/57 E |
| 3,494,047 | 2/1970 | Geiger et al. | 34/57 E |
| 3,600,817 | 8/1971 | Klein | 34/57 E |
| 3,956,456 | 5/1976 | Keller et al. | 423/171 |
| 4,201,541 | 5/1980 | Schoppe | 34/57 E |

FOREIGN PATENT DOCUMENTS

| | | | |
|---|---|---|---|
| 535927 | 4/1973 | Switzerland | 34/57 E |

*Primary Examiner*—John J. Camby

*Attorney, Agent, or Firm*—Robert F. Hause

[57] ABSTRACT

A processor for particulate material including a cylindrical vortex chamber, a main inlet duct communicating with the chamber at one otherwise closed end for supplying particulate substance in a direction substantially tangential to the interior surface of the vortex chamber and preferably inclined toward the other end, with the cylindrical portion of the vortex chamber being provided with a number of further inlets for the supply of active medium consisting essentially of slits in the vessel wall, with adjacent portions of vessel wall being bent out of the cylindrical curved plane, forming, by such bent portions, inlets which will direct the active medium into the vortex chamber in a tangential and inclined direction similar to the preferred direction of the inlet duct. A particulate material outlet and active medium outlet are also provided.

9 Claims, 4 Drawing Figures

CYCLONE PROCESSOR AND SEPARATOR

This invention relates to a simplified apparatus of the vortex or tornado flow type for effecting an exchange of substance and/or heat such as for the purpose of drying or performing chemical reactions. Known apparatus of this type requires considerable energy to operate and is relatively complex to construct and maintain.

Klein Pat. No. 3,600,817 and Keller et al U.S. Pat. No. 3,956,456 both relate to essentially the same structure of an upright cylindrical vortex or tornado flow chamber, with tangential downwardly slanted lower inlet pipes or nozzles, through which an active medium, such as hot air, is carefully directionally injected into the chamber or cylinder. These inlet pipes or nozzles are an additional set of structures that add to the complexity of building the apparatus and they add a certain amount of resistance to the material which pass therethrough.

The present invention replaces the inlet pipes or nozzles with a slit in the cylinder wall with portions of the wall adjacent the slit being bent to a shape which functions as a nozzle to direct the flow of active material into the cylinder to maintain therein the vortex of tornadoflow of material therein.

It is an object of the present invention to provide novel supplementary means for directionally injecting an active medium into a cylinder of helically flowing material.

It is a further object to provide a vortex or tornado flow cylindrical apparatus with reduced power requirements and easier construction.

These and other objects and advantages of the invention will be more readily apparent when considered in relation to the preferred embodiment of the invention as set forth in the specification and shown in the drawings in which.

Figure 1:
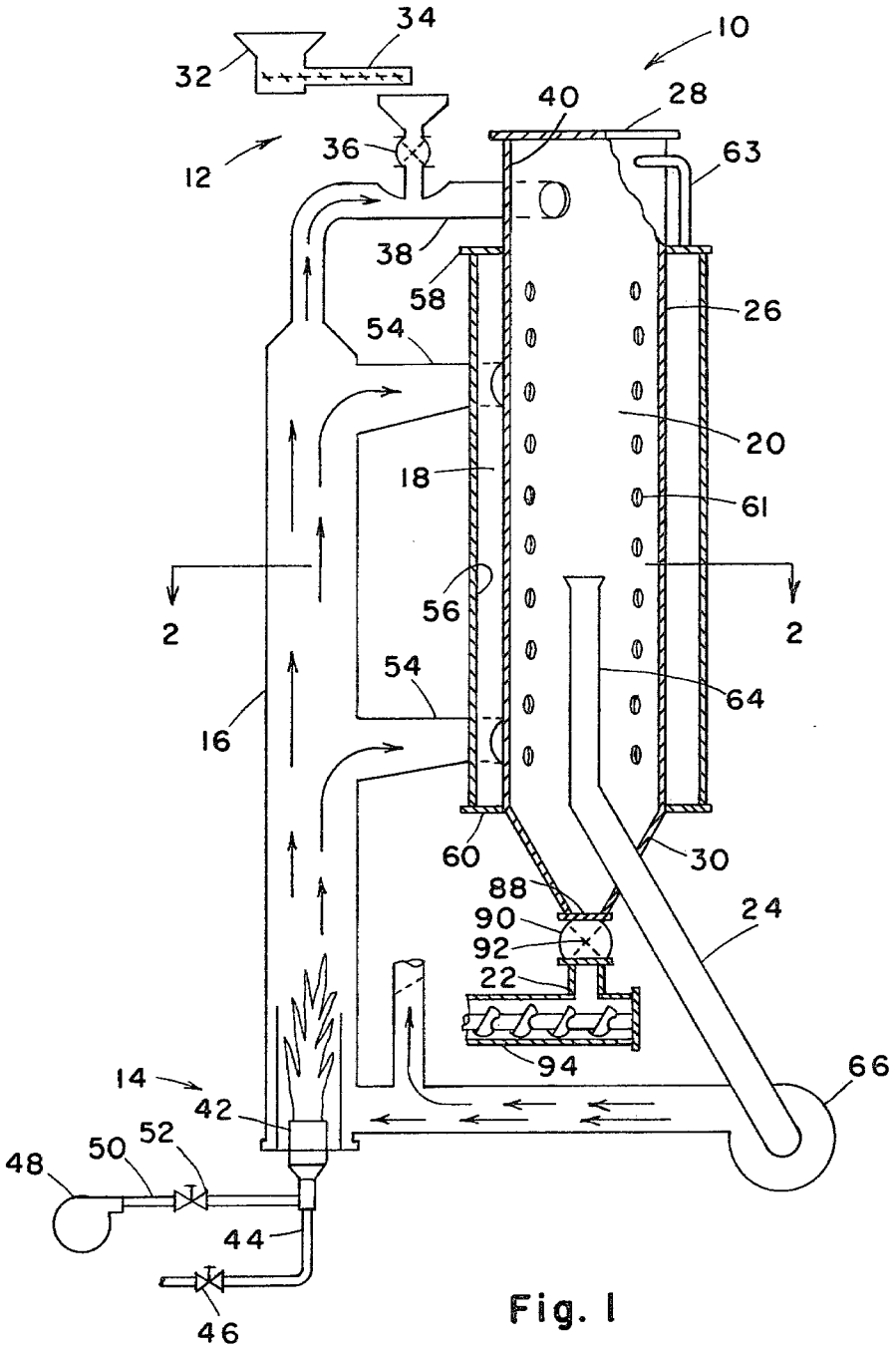
FIG. 1 is a partially diagrammatic view of apparatus for calcining gypsum including a calcining vortex chamber, constructed in accordance with the invention.

Referring to FIG. 1, there is shown partially diagrammatically a continuous flash calciner 10 for gypsum, including a gypsum feed section 12, a heat source 14, a hot gas plenum chamber 16, an inlet nozzle plenum 18, a vortex calcining zone 20, a product outlet 22 and a wet gas outlet 24.

The main portion of the novel calciner is the vortex calcining zone 20 which, in a preferred embodiment, is a nine and a half foot long standard carbon steel hollow calciner cylinder 26 of 16 inches inside diameter, with a covered top 28, and a frusto-conical hollow product discharge section 30 affixed to the bottom of cylinder 26.

Adjacent the top of cylinder 26 is the gypsum feed section 12. A finely ground gypsum powder, of about 90% through a 100 mesh screen, is supplied to a hopper 32 which provides a continuous supply to a controllably fixed speed screw feeder 34. Screw feeder 34 supplies a constant uniform supply of gypsum powder to a rotary valve 36 which provides a positive feed into a hot air inlet pipe 38 through which hot gas is constantly forced, into the top of the calciner cylinder 26. In the present embodiment, 5.9 tons per hour of gypsum are supplied to the calciner cylinder in order to produce 5 tons per hour of calcined gypsum.

The hot air inlet pipe 38 is one of several means by which hot air enters the calciner cylinder 26, all of which will be seen to be arranged to produce a high velocity clockwise rotary motion of hot gases and gypsum powder within the cylinder 26. Pipe 38 is adjoined to the wall of cylinder 26 so that the hot air and gypsum coming out of pipe 38 is moving substantially tangentially to the inner surface 40 of cylinder 26 as it enters cylinder 26.

The hot air used to heat the gypsum particles and convert them to calcium sulfate hemihydrate is heated directly by the flame of an oil fired burner 42, which is at the heat source 14 located at the bottom of the hot gas plenum chamber 16. This hot air is primarily recycled air which has already traveled through the calciner cylinder 26 and accordingly it will be understood that the term "hot air" is used loosely to mean the heated gases which include air, the products of combustion, and considerable vaporized water driven off the gypsum during the conversion to calcium sulfate hemihydrate as the air passed therethrough during previous cycles.

The heat source 14 further includes a fuel oil supply pipe 44 with suitable manual and automatic controls 46, and a combustion air blower 48 and air pipe 50 with suitable manual and automatic controls 52, both fuel pipe 44 and air pipe 50 providing constant fuel and air supplied to burner 42.

Recycled air is constantly fed through the flame of burner 42, moving upward in plenum chamber 16. This heated gas exits through either one of two side ducts 54 or the hot air inlet pipe 38 at the top. The hot air inlet pipe 38 provides a means of conveying the gypsum feed from below rotary valve 36 into the calciner cylinder 26, as discussed above.

The two ducts 54 conduct the hot air to the inlet nozzle plenum 18 which completely surrounds most of the full length of the calciner cylinder 26. The inlet nozzle plenum 18 is an 8 foot long standard carbon steel hollow cylinder of 32 inches outside diameter, concentrically surrounding the lower eight feet of the nine and a half foot long calciner cylinder 26. The ducts 54 are adjoined to the wall of the inlet nozzle plenum 18, one near the top and one near the bottom, so that the hot air coming out of the ducts is moving substantially tangentially to the inner surface 56 of plenum 18 as it enters plenum 18, producing a clockwise rotary motion of hot air in the space between inner surface 56 and the cylinder 26. The inlet nozzle plenum 18 is closed by a top cover 58 and a bottom cover 60.

All of the hot air entering the inlet nozzle plenum 18 through ducts 54 proceeds to flow therefrom into the vortex calciner cylinder 26 through a plurality of cylinder wall slits 61 with adjacent deformed wall portions 62 or through a top inlet pipe 63. Each slit 61 and its adjacent deformed wall portion 62 is constructed so that the hot air passing therethrough is moving substantially tangentially to the inner surface 40 of the calciner cylinder, which, in cooperation with the hot air coming in through pipes 38 and 63, produces a clockwise rotary and slightly downward motion of hot air and of the gypsum particles in the calciner cylinder 26.

Figure 3:
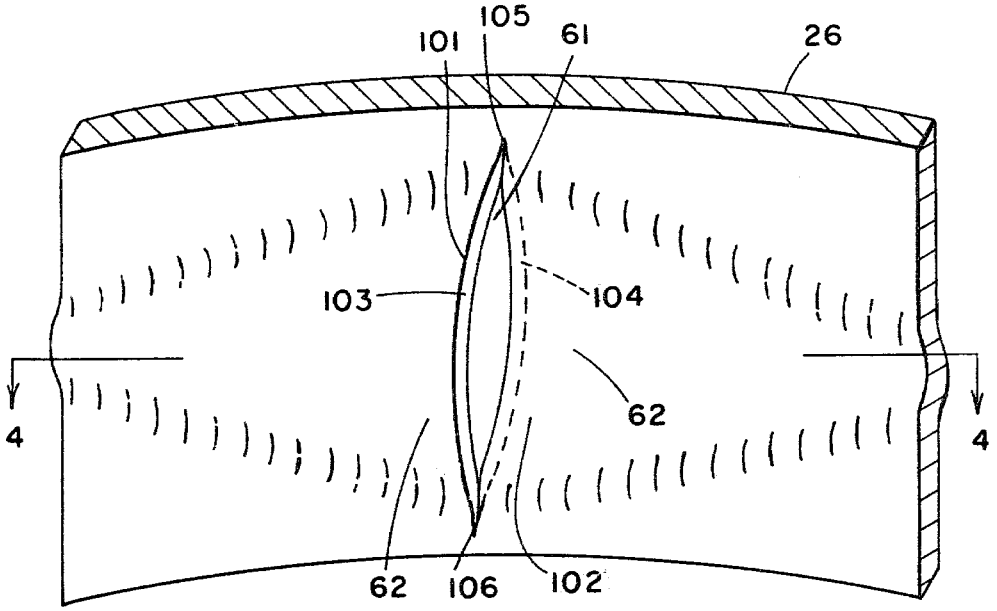
FIG. 3 is a perspective view of a section of the wall of the vortex chamber, showing a novel directional inlet for active medium.
Figure 4:
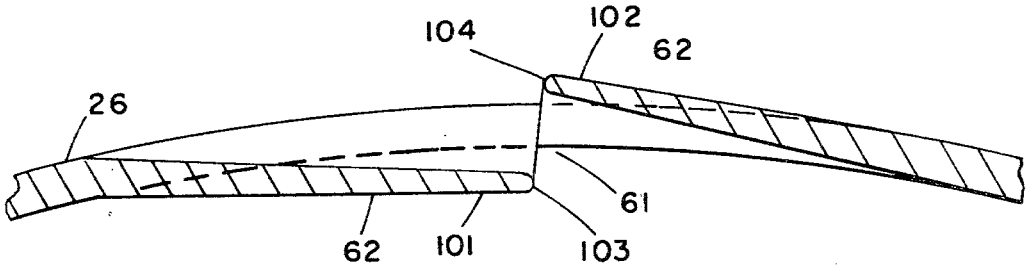
FIG. 4 is a cross-sectional enlarged plan view, similar to FIG. 2, taken along line 4—4 of FIG. 3.

Referring to FIGS. 3 and 4, each slit 61 with adjacent deformed wall portions 62, in the preferred form includes an inwardly depressed portion 101 on the upsteam side of slit 61 and an outwardly depressed portion 102 on the downstream side of slit 61, each with a very thin edge 103, 104. One or the other of the two depressed portions 101 and 102 can be omitted, inwardly depressed portion 101 being preferably the one that is omitted, if one is to be omitted.

The preferred form of the adjacent depressed wall portions 101 and 102, as shown in FIGS. 3 and 4, is that of an elongated or very tall half cone extending substantially horizontally, preferably 1°–15° from horizontal, with the cone base at the slit, and with the upper and lower extremities of the depressed portion being reversely folded to blend smoothly into the cylinder wall thereabout. The opening formed at slit 61 has an opening area of about two square inches, in a plane perpendicular to the direction of air flow therethrough.

Figure 2:
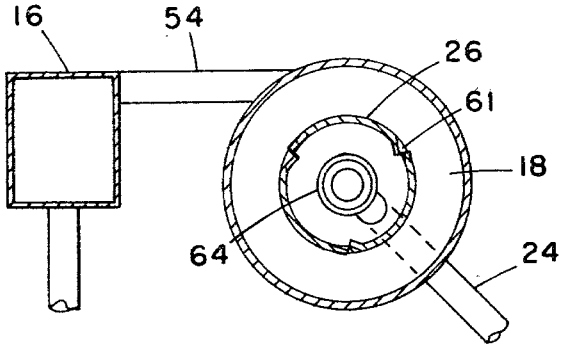
FIG. 2 is a cross-sectional plan view of the vortex chamber of FIG. 1, taken along line 2—2.

Slit 61 is preferably at a slightly slanted angle from vertical, with the top 105 of the slit disposed slightly downstream relative to the bottom of the slit 106. Accordingly hot air passing therethrough is directed tangentially and slightly downward, preferably between about 1° and 15° downward. The slits 61 are located uniformly about the circumference, and along the height of the vortex calciner cylinder 26, with, for example, two vertical rows of ten slits 61 being shown on the back half of the vortex calciner cylinder seen in FIG. 1, it being understood that a third row is disposed opposite the two rows shown, in the front half, see FIG. 2. The hot air adjacent the inner surface 40 thus progresses downwardly slowly, relative to its rotary speed, forcing, by centrifugal action, the calcining gypsum outwardly into the downwardly spiraling hot air. Meanwhile, air that is further from the inner surface 40, and contains very little gypsum, moves toward a gas outlet 24 disposed on the central vertical axis of the calciner cylinder.

The gas outlet 24 consists of an upwardly opening vertical outlet pipe 64, which extends about one-third of the way up from the bottom toward the top of calciner cylinder 26. This pipe could terminate elsewhere along the central axis or it could have a plurality of openings along its length. Pipe 64 extends coaxially part way down into product discharge section 30 and then it is bent to extend out through the wall of product discharge section 30. Outlet pipe 64 terminates at a primary air fan 66, which pulls air out of the center of the calciner cylinder 26 and forces air, most of which proceeds through the flame of burner 42 and into the hot gas plenum chamber 16, as described above.

Considering further the calciner 10, the product outlet 22 will be seen to be located at the very bottom of the frustoconical product discharge section 30. As the calcining gypsum moves downward through the calcining cylinder 26 it is centrifugally forced away from the central axis by the rapidly spiralling hot air. As the gypsum moves downward through the discharge section 30, the frustoconical shape directs the calcined gypsum inwardly to a central axial opening 88, and thence to a rotary valve 90. Rotary valve 90 has rotating blades 92 positively driving the exiting calcined gypsum downward to the inlet of a screw conveyor 94, which continuously conveys the calcined gypsum to any suitable storage bin, cooler, or product bagger, not shown.

The above preferred embodiment of the invention has been described as a calciner for gypsum, a use similar to the use of the apparatus of the Keller et al patent. The novel slits and deformed wall adjacent thereto are also suitable in apparatus intended for all of the uses suggested in the Klein et al patent.

Having completed a detailed disclosure of the preferred embodiments of my invention, so that others may practice the same, I contemplate that variations may be made without departing from the essence of the invention.

I claim:

1. Processing apparatus for effecting interaction between, and subsequent separation of, gaseous and solid or liquid particulate substances, comprising an elongated cylindrical vortex chamber and having near one end an inlet duct means substantially tangential to said cylindrical chamber, said cylindrical vortex chamber having a plurality of further inlets for active medium, each said further inlet consisting essentially of a substantially vertically extending slit in the chamber wall and a deformed section of chamber wall on at least one side of said slit, said deformed section of wall forming an opening suitable for passage of said active medium, said deformed section of chamber wall being formed to direct entering active medium tangentially in substantially the same rotary direction as said inlet duct means, said deformed section of chamber wall having substantially the form of a relatively long half-cone with the cone base at said slit, said active medium inlets being distributed in an array along and around said chamber wall, and suitable outlet means for all of said gaseous and solid or liquid substances.

2. Processing apparatus as defined in claim 1 wherein each said slit has an inwardly deformed section on an upstream side and an outwardly deformed section on a downstream side.

3. Processing apparatus as defined in claim 1 wherein said cone base at said slit is tapered to a thin edge.

4. Processing apparatus as defined in claim 1 wherein each said deformed section is formed to direct entering active medium tangentially and downwardly at an angle of from 1° to 15° from horizontal.

5. Processing apparatus as defined in claim 1 wherein said cylindrical chamber has an inlet nozzle plenum disposed around a substantial portion of said chamber wall, said plenum having means for feeding active medium thereto in a direction tangential to the outer surface of said chamber wall.

6. Processing apparatus as defined in claim 5 wherein each said slit has an inwardly deformed section on an upstream side and an outwardly deformed section on a downstream side.

7. Processing apparatus as defined in claim 5 wherein each said deformed section is formed to direct entering active medium tangentially and downwardly at an angle of from 1° to 15° from horizontal.

8. Processing apparatus as defined in claim 5 wherein each said slit has an inwardly deformed section on an upstream side and an outwardly deformed section on a downstream side, and each said deformed section has substantially the form of a relatively long half-cone with the cone base at said slit, and formed to direct entering active medium tangentially and downwardly at an angle of from 1° to 15° from horizontal.

9. A flash calciner for gypsum having a gypsum calcining zone constructed in accordance with the processing apparatus as defined in claim 1.

* * * * *